US006032470A

United States Patent [19]

Haselden

[11] Patent Number: 6,032,470

[45] Date of Patent: Mar. 7, 2000

[54] PLATE HEAT EXCHANGER

[75] Inventor: Geoffrey Gordon Haselden, Leeds, United Kingdom

[73] Assignee: BTG International Inc., Gulph Mills, Pa.

[21] Appl. No.: 09/181,909

[22] Filed: Oct. 29, 1998

Related U.S. Application Data

[62] Division of application No. 08/880,737, Jun. 23, 1997, Pat. No. 5,875,838, which is a continuation of application No. PCT/GB95/02983, Dec. 20, 1995.

[30] Foreign Application Priority Data

Dec. 23, 1994 [GB] United Kingdom ..... 9426208

[51] Int. Cl.[7] ..... F25B 39/04

[52] U.S. Cl. ..... 62/114

[58] Field of Search ..... 62/114; 252/67

[56] References Cited

U.S. PATENT DOCUMENTS

| | | |
|---|---|---|
| 266,220 | 10/1882 | Strong . |
| 708,712 | 9/1902 | Hill . |
| 1,622,376 | 3/1927 | Davenport . |
| 1,689,927 | 10/1928 | Newhouse . |
| 2,117,337 | 5/1938 | Löbl et al. . |
| 2,285,225 | 6/1942 | Norris . |
| 2,610,478 | 9/1952 | Lofstedt . |
| 2,689,839 | 9/1954 | Heckert . |
| 2,872,165 | 2/1959 | Wennerberg . |
| 2,958,206 | 11/1960 | Ewing . |
| 3,117,624 | 1/1964 | Wennerberg . |
| 3,175,962 | 3/1965 | Holtslag . |
| 3,282,797 | 11/1966 | Hammer . |
| 3,399,708 | 9/1968 | Usher et al. . |
| 3,412,777 | 11/1968 | Dönell et al. . |
| 3,724,523 | 4/1973 | Mattern . |
| 3,800,868 | 4/1974 | Berkowitz et al. . |
| 3,862,661 | 1/1975 | Kavalenko et al. . |

(List continued on next page.)

FOREIGN PATENT DOCUMENTS

| | | |
|---|---|---|
| 128699 | 5/1946 | Australia . |
| 32693 | 8/1969 | Australia . |
| 14766 | 12/1977 | Australia . |
| 0 014 066 | 8/1980 | European Pat. Off. . |
| 0 289 915 | 11/1988 | European Pat. Off. . |
| 957533 | 2/1950 | France . |
| 1552439 | 1/1969 | France . |
| 661 278 | 6/1938 | Germany . |
| 681 501 | 9/1939 | Germany . |
| 2 109 346 | 10/1971 | Germany . |
| 29 30 230 | 2/1980 | Germany . |
| 32 20 774 | 12/1983 | Germany . |
| 6800753 | 7/1968 | Netherlands . |
| 132 411 | 7/1951 | Sweden . |
| 212 211 | 4/1967 | Sweden . |

(List continued on next page.)

*Primary Examiner*—William E. Tapolcai
*Attorney, Agent, or Firm*—Nixon & Vanderhye

[57] ABSTRACT

Plate eat exchangers are disclosed which accommodate variations in the relative proportions of liquid and vapour refrigerant, allowing the refrigerant in the two phases to remain in equilibrium throughout the flow path through the heat exchanger. The flow path can be arranged to be boustrophedonic so that it comprises first and second sets of alternating parallel sub-channels in which the resistance to flow of refrigerant fluid along each of the sub-channels of the first set is greater than the resistance to flow along the respective adjacent sub-channels of the second set. The configuration of the channel for the refrigerant through the heat exchanger can be arranged so that the resistance to the flow of refrigerant is greater towards one end than towards the other end. This can be achieved by one or more of the plates having a surface profile which is configured so that the resistance to flow of heat exchange fluid along the channel is greater in one region along the length of the channel than in another region.

6 Claims, 6 Drawing Sheets

U.S. PATENT DOCUMENTS

Figure 1:
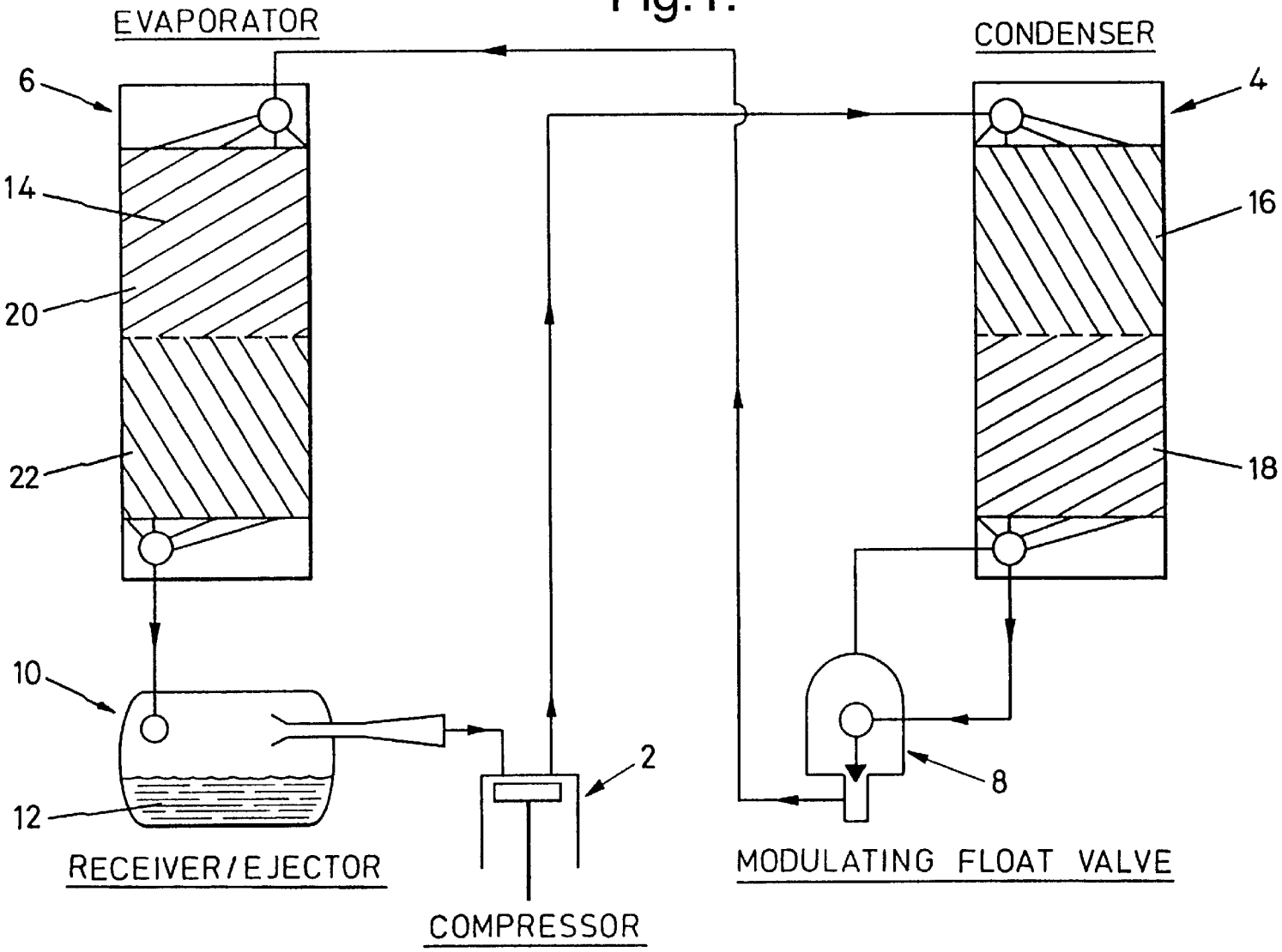

| | | | |
|---|---|---|---|
| 4,156,459 | 5/1979 | Kusuda et al. . | |
| 4,182,411 | 1/1980 | Sumitomo et al. . | |
| 4,230,179 | 10/1980 | Uehara et al. . | |
| 4,301,864 | 11/1981 | Kivikas et al. . | |
| 4,307,779 | 12/1981 | Johansson et al. . | |
| 4,370,868 | 2/1983 | Kim et al. . | |
| 4,376,460 | 3/1983 | Skoog . | |
| 4,434,643 | 3/1984 | Almqvist et al. . | |
| 4,586,565 | 5/1986 | Hallström et al. . | |
| 4,630,674 | 12/1986 | Skoog . | |
| 4,678,030 | 7/1987 | Almqvist . | |
| 4,936,380 | 6/1990 | Niggemann . | |
| 5,172,759 | 12/1992 | Shimoya et al. . | |
| 5,174,370 | 12/1992 | Hallgren . | |
| 5,226,474 | 7/1993 | Hallgren . | |
| 5,245,843 | 9/1993 | Shimoya et al. . | |
| 5,385,034 | 1/1995 | Haselden . | |
| 5,792,381 | 8/1998 | Gu | 62/114 |

FOREIGN PATENT DOCUMENTS

| | | |
|---|---|---|
| 219 561 | 3/1968 | Sweden . |
| 321 492 | 3/1970 | Sweden . |
| 420 020 | 9/1981 | Sweden . |
| 424 143 | 7/1982 | Sweden . |
| 426 653 | 2/1983 | Sweden . |
| 448 916 | 3/1987 | Sweden . |
| 458 805 | 5/1989 | Sweden . |
| 462 060 | 4/1990 | Sweden . |
| 530420 | 6/1939 | United Kingdom . |
| 788193 | 12/1957 | United Kingdom . |
| 859876 | 1/1961 | United Kingdom . |
| 892021 | 3/1962 | United Kingdom . |
| 974470 | 11/1964 | United Kingdom . |
| 1032058 | 6/1966 | United Kingdom . |
| 1038058 | 8/1966 | United Kingdom . |
| 1084292 | 9/1967 | United Kingdom . |
| 1197963 | 7/1970 | United Kingdom . |
| 1 286 446 | 8/1972 | United Kingdom . |
| 1 339 542 | 12/1973 | United Kingdom . |
| 1 377 789 | 12/1974 | United Kingdom . |
| 1 565 869 | 4/1980 | United Kingdom . |
| 2 040 432 | 8/1980 | United Kingdom . |
| 2 089 226 | 6/1982 | United Kingdom . |
| 2 089 666 | 6/1982 | United Kingdom . |
| WO 91/16589 | 10/1991 | WIPO .- |

PLATE HEAT EXCHANGER

This application is a division of application Ser. No. 08/880,737, filed on Jun. 23, 1997, now U.S. Pat. No. 5,875,838, which in turn is a continuation of PCT Application GB95/02983, filed on Dec. 20, 1995.

This invention relates to a plate heat exchanger such as might be used in a vapour compression system. The heat exchanger can be used for evaporating or condensing a flowing fluid, and is particularly suitable for use where the fluid comprises a mixture of mutually soluble refrigerant substances with different boiling points (such that the mixture boils or condenses through a temperature range). The heat exchanger can be used for example in an air conditioner, a refrigerator, a heat pump or the like. The invention also relates to a vapour compression system which include a plate heat exchanger, and to a method of operating a vapour compression system.

Plate heat exchangers comprise several plates joined to one another in face-to-face relationship; a seal between them can be provided by means of, for example, welding, adhesive bonding, or clamps. The plates are formed with appropriate surface profiles so that a channel is defined between each pair of adjoining plates for the flow of fluid through the space between the plates, from an inlet end of the space to an outlet end. The heat exchangers are generally configured so that more than two plates provide channels or passages between alternating pairs of plates, for flow of two different fluids which are in heat exchange relationship. One of the fluids can be a refrigerant material undergoing a phase change while the other will be a process fluid, possibly a liquid (such as water) or a gas (such as air), which is to be heated or cooled as the case may be.

The surface area for heat exchange can be increased by means of fins. The fins can be provided for the heat exchange fluid (such as the refrigerant) flowing in the channel between the plates. They can also be provided for the process fluid (such as water or air) to be heated or cooled.

The heat exchanger of this type will often be arranged so that there is countercurrent flow between the fluids that are in heat exchange relationship. The two phases of a heat exchange material preferably flow cocurrently in the channel for that material so that, at any point along the channel, the separate phases are each well mixed and there is effective mixing between the phases. This condition can be referred to as equilibrium evaporation or condensation. It can arise for example when liquid and vapour flow cocurrently with vapour flowing down the bore of the channel, and liquid flowing along the channel walls effectively as a varying thickness film around the flowing vapour. Preferably, the equilibrium conditions of evaporation or condensation are sustained throughout substantially the entire length of the evaporator or condenser (as the case may be). This can be difficult to achieve because the change in phase is accompanied by a large change in volume, which affects the flow condition of the two phases.

Equilibrium conditions for evaporation and condensation are particularly desirable when one or each of the fluids involved in the heat exchange comprises a mixture of mutually soluble refrigerant substances with different boiling points, which do not form an azeotrope. Such mixtures can have boiling points separated by at least about 10° C., for example at least about 20° C. The difference in boiling points will often be less than about 70° C., preferably less than about 60° C., for example less than about 50° C. It enables optimum heat exchange to take place with the fluid mixture across the range of its boiling points, which can then be arranged to match the range of temperatures of the process fluid with which it is in heat exchange relationship as the process fluid flows along the heat exchanger. It is desirable therefore for the channel for the heat exchange fluid to be arranged so that cocurrent flow of its two phases, and preferably also flow at the same speed, occurs in spite of the large change of volumetric flow rate.

This can reduce phase separation, or enrichment of a particular component of a mixture.

The present invention provides a plate heat exchanger in which the configuration of the channel is such that the resistance provided by the channel to the flow of fluid along it is greater in a first region towards one end than in a second region towards the other end.

Accordingly in one aspect, the invention provides a heat exchanger which comprises at least two plates which a re connected to one another in face-to-face relationship, the plates defining a channel in the space between them for flow of heat exchange fluid through the space from an inlet end thereof to an outlet end and the external surfaces of the plates being available for heat exchange with another fluid, the configuration of the channel being such that the resistance provided by the channel to the flow of heat exchange fluid along it is greater in a first region towards one end of the channel than in a second region towards the other end of the channel, at least one of the plates having a surface profile which gives rise to the resistance to flow of the fluid through the channel, the surface profile being configured so that the resistance to flow of heat exchange fluid along the channel is greater in one region along the length of the channel than in another region.

The present invention provides a heat exchanger which facilitates cocurrent flow of heat exchange fluid in vapour and liquid phases throughout the length of a heat exchanger, providing as a result for effective equilibrium condensation or evaporation along substantially the entire length of the exchanger in which the two phases of the heat exchange fluid flow together in the channel so that, at any point along the channel, the separate phases are each well mixed and there is effective mixing between the phases. In particular, the heat exchanger can accommodate the changes in volume in the heat exchange fluid which take place on condensation or evaporation, as the case may be, along the length of the heat exchanger. Thus, the variation in flow resistance provided by the channel can ensure that liquid and vapour fluid continue to mix effectively as the relative proportions of the fluid in the two phases change.

The heat exchanger of the invention has the particular advantage that it facilitates the use of wide boiling mixtures of refrigerant materials which are required to evaporate or condense under near equilibrium conditions throughout the length of the evaporator or condenser as the case may be. This feature of the invention is significant. It can ensure that the rate of flow of refrigerant along the channel is maintained relatively uniform so that separation of vapour and liquid phase refrigerant is minimised. It facilitates cocurrent flow of refrigerant in liquid and vapour phases, with vapour flowing down the bore of the channel and liquid flowing along the channel walls effectively in a varying thickness film around the flowing vapour, making these conditions possible along substantially the entire length of the channel. In this way, the equilibrium conditions for evaporation or condensation can be maintained across the phase change temperature range of the refrigerant mixture.

The configuration of the channel in the heat exchanger is such that the resistance provided by the channel to the flow of heat exchange fluid along it is greater in a region towards one end than in a region towards the other end. This might be achieved in any of a number of ways. For example, the cross-sectional area of the channel can be greater towards one end than towards the other end. Accordingly, when the heat exchanger is an evaporator, the cross-sectional area will be greater towards the outlet end than towards the inlet end; when the heat exchanger is a condenser, the cross-sectional area will be greater towards the inlet end than towards the outlet end.

The variation in cross-sectional area of the channel can result from formations in the plates. Alternatively or in addition, the variation can result from appropriate channel defining members, as walls, located between the plates.

The or each plate can have formations which extend out of the plane of the plate so that formations are provided in the walls of the channels, along at least part of the length of the channel. The formations can be provided by appropriate deformation of the material of the plate, for example to introduce corrugations into the plate. The corrugations can be straight, although heat resistance to flow can be affected by making the corrugations "wavy". Formations can be formed by stamping and can as a result be made non-continuous along their length in the direction of flow of fluid. The formations can include apertures for fluid to pass through, from one side of the plate to the other. The configuration of the formations is such that the resistance that they provide to the flow of heat exchange fluid is greater in one region along the length of the channel than at another region. Appropriate formations can be formed as corrugations which are arranged at least partly transversely to the direction of flow of fluid through the channel. Fluid is caused to pass over the formations as it flows along the channel, at least along a part of the length of the channel, but preferably along substantially the entire length of the channel.

Formations can be formed by providing material on a surface of the or each plate, for example by bonding (for example using an adhesive, welding, brazing or another suitable technique) a sheet of material with a wavy configuration to the said surface.

Formations will preferably be provided in both of the plates which define the channel, which cooperate to provide the required in resistance to flow of fluid along the channel.

However, the resistance can be provided for some applications by a planar plate cooperating with a plate with formations.

In addition to affecting flow resistance, formations provided in one or each of the plates can strengthen the plate so that it can withstand the pressures to which the heat exchanger is subjected when in use.

The variation in the configuration of the formations between the said regions of the channel can be in a characteristic such as (a) the angle of the formations to the flow of heat exchange fluid, (b) the depth of the formations, and (c) the wavelength of the formations. For example, the resistance to flow of fluid can be increased by increasing the angle of incidence of formations to the fluid flow direction. Alternatively or in addition, the resistance to fluid flow can be increased by increasing the depth of the formations that the fluid is forced to follow as it flows along the channel. Alternatively or in addition, the resistance to fluid flow can be increased by shortening the distance between adjacent peaks in the array of formations, that is by shortening the "wavelength" of the formations.

Fins can be provided between the plates. They can be provided in the channel for flow of the heat exchange fluid. Alternatively or in addition, they can be provided in the passage or channel for flow of the process fluid. The fins can direct the flow of the fluid that flows over them. They can also affect the resistance to flow of the fluid, for example as a result of frictional effects, or by changing the cross-sectional area of the channel or passage for fluid flow.

When fins are provided for both the heat exchange fluid and the process fluid, the pattern of fins can differ from one fluid to the other. For example, the fins for the heat exchange fluid can define a channel in which the fluid flows alternately generally upwardly and downwardly while the channel or passage for the process fluid can be essentially straight through the heat exchanger.

The incorporation of fins has the advantage that they can reinforce the heat exchanger to enhance its ability to withstand the pressures to which it is subjected in use.

The first and second regions of the channel, with the differing resistances to flow, are located so that the fluid flows sequentially from one region to the other as it flows from the inlet end of the channel to the outlet end. The regions need not extend to the ends of the channel. For example, there can be manifold regions associated with the inlet or the outlet or both by which fluid is distributed between parallel channels between a pair of plates. The resistance to flow can be affected (increased or decreased) in the manifold regions.

The resistance to flow of the heat exchange fluid along the channel can change continuously along at least a portion of the length of the channel and, in some circumstances, along substantially the entire length of the channel. The resistance to the said flow can vary sharply at specific points along the length of the channel. The number of such points will depend on, for example, the overall change in resistance that is required over the length of the channel and the change in the resistance at each such point. It can be appropriate in some constructions of heat exchanger for the resistance to flow to change at at least two points along the length of the channel, for example at three or four points, so that there are three, four or five regions with differing levels of resistance along the length of the channel.

The path of the channel defined by plates can be boustrophedonic. The path then comprises first and second sets of alternating parallel sub-channels. The sub-channels can be arranged so that the fluid flows horizontally in the first set or the second set or both. It is preferred that the fluid flows generally vertically in at least one of the first and second sets, for example generally downwardly in the first set and generally upwardly in the second set. Vertical flow has the advantage of minimising segregation between refrigerant in liquid and vapour phases, in particular due to the effect of gravity.

In another aspect, the invention provides a method of operating a vapour compression system which comprises at least two plates connected to one another in face-to-face relationship, the plates defining a channel in the space between them for flow of heat exchange fluid through the space from an inlet end thereof to an outlet end, the configuration of the channel being such that the resistance provided by the channel to the flow of heat exchange fluid along it is greater in a first region towards one end of the channel than in a second region towards the other end of the channel, the method comprising causing the heat exchange fluid to flow generally vertically upwardly while flowing in the channel, in heat exchange relationship with another fluid.

In a vapour compression system operated according to the method of the invention, it is possible for refrigerant vapour to drive liquid refrigerant upwardly in the channel in the heat exchanger at substantially the same speed as the vapour, especially so that effective equilibrium condensation or evaporation takes place along the upward limb of the channel, and preferably also along the downward limb.

In a further aspect, the invention provides a heat exchanger which comprises at least two plates which are connected to one another in face-to-face relationship, the plates defining a channel in the space between them for flow of heat exchange fluid through the space from an inlet end thereof to an outlet end and the external surfaces of the plates being available for heat exchange with another fluid, the path of the channel being boustrophedonic and so comprising first and second sets of alternating parallel sub-channels in which the resistance to flow of refrigerant fluid along each of the sub-channels of the first set is greater than the resistance to flow along the respective adjacent sub-channels of the second set.

The sub-channels can be defined by formations on the plates. They can be defined by channel defining members located between the plates. They can be defined, or fluid can be made to flow along them, by fins located between the plates.

Preferably, the resistance to flow of refrigerant fluid along the sub-channels of the first set is greater than the resistance to flow along the sub-channels of the second set. In this way, the control over the flow rates of fluid as it flows along the channel will be provided in the sub-channels of the first set, with fluid being able to flow relatively easily along the sub-channels of the second set. In this arrangement, heat exchange will take place primarily in the sub-channels of the first set, the channel can be configured for heat exchange to take place with the heat exchange fluid in the channel while it is in the sub-channels of the said first set. The arrangement has the advantage that mixing of fluid in liquid and vapour phases is possible in the low resistance sub-channels, facilitating equilibrium condensation or evaporation in the high resistance sub-channels. When the resistance to flow differs between the first and second sets of sub-channels, it is preferred that the fluid flow in the higher resistance set is generally downwardly and the fluid flow in the lower resistance set is generally upwardly so that separation of the phases due to gravity effects is minimised.

Preferably, the configuration of the channel is such that first set of sub-channels includes at least two sub-channels, for example three or four of the sub-channels, connected by the sub-channel(s) of the second set.

When the channel comprises a first set of two or more sub-channels, the variation in the resistance to flow of heat exchange fluid can be introduced between successive sub-channels of the first set, conveniently with the resistance to flow in each sub-channel being substantially constant. Such variation can take into account for example variations in the proportions of liquid and vapour refrigerant as the refrigerant passes through the heat exchanger.

Preferably, the heat exchanger comprises at least three plates arranged so as to define the channel for flow of the heat exchange fluid between a first pair of the plates, and a channel or passage for flow of another fluid between the adjacent pair of plates in heat exchange with the heat exchange fluid between the first pair of plates. Generally, the heat exchanger will comprise several plates, with channels for flow of the two heat exchanging fluids being provided between alternate pairs of the plates. The invention does however also provide a heat exchanger consisting of two plates which define a space between them for heat exchange fluid to flow through, in heat exchange relationship with a process fluid which flows over the said plates.

Preferably, the heat exchanger includes at least four of the plates connected together in two pairs, with a path defined between the two pairs for the said other fluid to flow in when in heat exchange relationship with the heat exchange fluid flowing in the boustrophedonic channels defined by the plates of the two pairs.

The invention provides a device for distributing refrigerant in both liquid and vapour phases between channels in a heat exchanger, which comprises:

(a) a distribution tube, (b) ports for discharge of refrigerant from the tube into the channels of the heat exchanger, the size of the ports for discharge of refrigerant vapour being restricted so that there is a pressure drop across those ports, and (c) an inlet for refrigerant to enter the distribution tube configured so that the refrigerant entering the tube is turbulent and so that refrigerant in liquid and vapour phases is in equilibrium in the tube.

The channels between which the device distributes the refrigerant can be provided by spaced apart pairs of plates, for example the two pairs of plates in a stack of four plates.

Preferably, turbulence is introduced to the refrigerant in the tube by discharging it into the tube towards one end thereof, so that it is directed from the inlet towards an end wall of the tube. This might be achieved for example by providing a bend on the end of the inlet, or having the opening for refrigerant from the inlet in the side of an inlet tube. Preferably, the end of the tube of the device at which the refrigerant is discharged is flared, and especially generally rounded.

Preferably, the outlet ports in the tube are circumferentially spaced around the tube, so that some provide for discharge of liquid refrigerant and some provide for discharge of vapour refrigerant. Holes towards the bottom of the tube can provide for discharge of liquid refrigerant when present and holes towards the top of the tube can provide for discharge of vapour refrigerant. Preferably, the holes towards the top of the tube are bigger than the holes towards the bottom of the tube so that the relative proportions of discharged liquid and vapour refrigerant are controlled.

Holes in the tube can be provided for individual channels, or between pairs of channels so that refrigerant discharged from holes at a particular point along the tube flows into two adjacent channels.

The heat exchanger of the invention can be used to exchange heat between a refrigerant flowing in the channel between the plates and a process fluid which is, for example, in liquid phase or vapour phase. The configuration of the path provided for flow of the process fluid depends on a number of factors such as the phase of the process fluid. The fluid can flow along a channel between pairs of plates; this construction is well suited to a process fluid in liquid phase, and to a process fluid whose phase changes between liquid and vapour as a result of the exchange of heat. In this latter case, it can be appropriate for the resistance to flow of the process fluid to be greater in a region towards one end of its channel than in a region towards the other end, as discussed above.

The path for flow of the process fluid can be essentially open for flow of the process fluid over the plates which define the channel, generally with fins on the plate surfaces to optimise exchange of heat. This construction is well suited for heat exchange with process fluids in gaseous or vapour phase.

It can be preferred for the resistance to flow of one and preferably each of the fluids that are in heat exchange relationship across the plates to be greater at one end of the respective channel than at its other end, making the heat exchanger suitable for use in the exchange of heat between two materials which both change phase in the heat exchange.

In another aspect, the invention provides a heat exchanger which comprises a plurality of plates defining channels for flow of at least two fluids for heat exchange between adjacent pairs of the plates for respective ones of the fluids which are to be in heat exchanging relationship when the exchanger is in use, the channels for a first one of the fluids being interposed between the channels for a second fluid, in which:

(a) each of the channels for the first fluid defining a boustrophedonic path between the inlet end of the channel and the outlet end whose cross-sectional area increases from one end of the path to the other end, and (b) each of the channels for the second fluid has a substantially straight path.

A heat exchanger in accordance with this aspect of the invention can be used for heat exchange between a heat exchange fluid such as a refrigerant and a process fluid such as a compressed gas, especially when it has to be cooled in large quantities.

Preferably, the channels of the first set are each made up of multiple parallel sub-channels which are sufficiently narrow to prevent separation of refrigerant into vapour and liquid components.

Preferably, the heat exchanger is arranged so that the channels of the first set provide vertical paths for flow of refrigerant, generally upwardly and downwardly.

Preferably, the channels for one or both of the first and second fluids contain fins, especially with at least some of the fins being provided as plates extending generally along the channel.

In a further aspect, the invention provides a vapour compression system which includes a heat exchanger of one of the types discussed above. In the system of the invention, the heat exchanger can be arranged to function as an evaporator which receives refrigerant at least mainly in liquid phase, and discharges refrigerant vapour (which is preferably slightly wet) The said heat exchanger can be arranged alternatively to function as a condenser which receives refrigerant vapour and discharges refrigerant at least mainly in liquid phase. The system can include an evaporator and a condenser, each of which is of the general type discussed above.

The heat exchanger is preferably mounted so that heat exchange fluid flows generally downwardly while in heat exchange relationship with the fluid with which it is to exchange heat.

Examples of materials which are suitable for use as refrigerants in a single refrigerant system include those designated by the marks R22 and R134*a*. A particular advantage of the system of the invention is that it is well suited to the use of wide boiling non-azeotropic mixed refrigerants in which it is particularly desirable that, at all places within the condenser and the evaporator, liquid and vapour refrigerant flow together cocurrently and are in equilibrium, whilst the refrigerant mixture flows essentially counter-currently with the fluid with which it is exchanging heat. Examples of suitable mixed refrigerants include those designated by the marks R23/R134*a* and R32/R227. It will be understood that the term "refrigerant", used in this document to denote the fluid circulating in the vapour compression system, is applicable to the fluid which circulates in systems which function as air conditioners or heat pumps.

Figure 2:
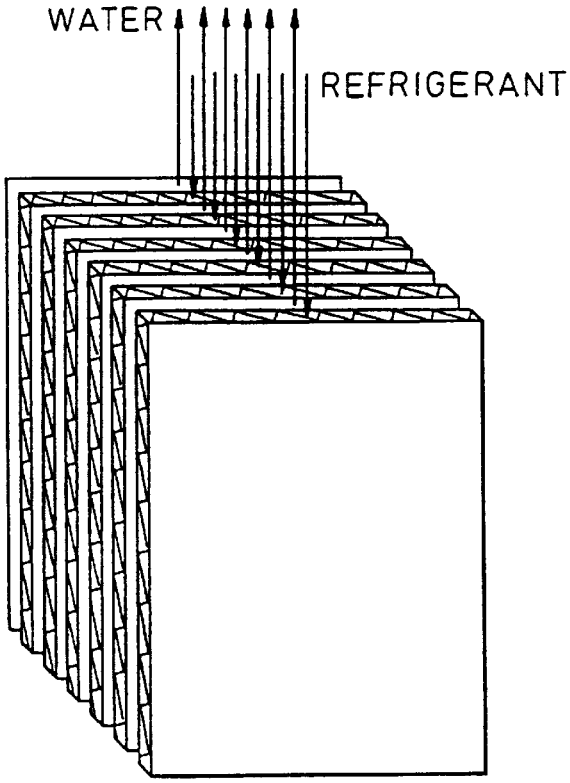
Figure 5:
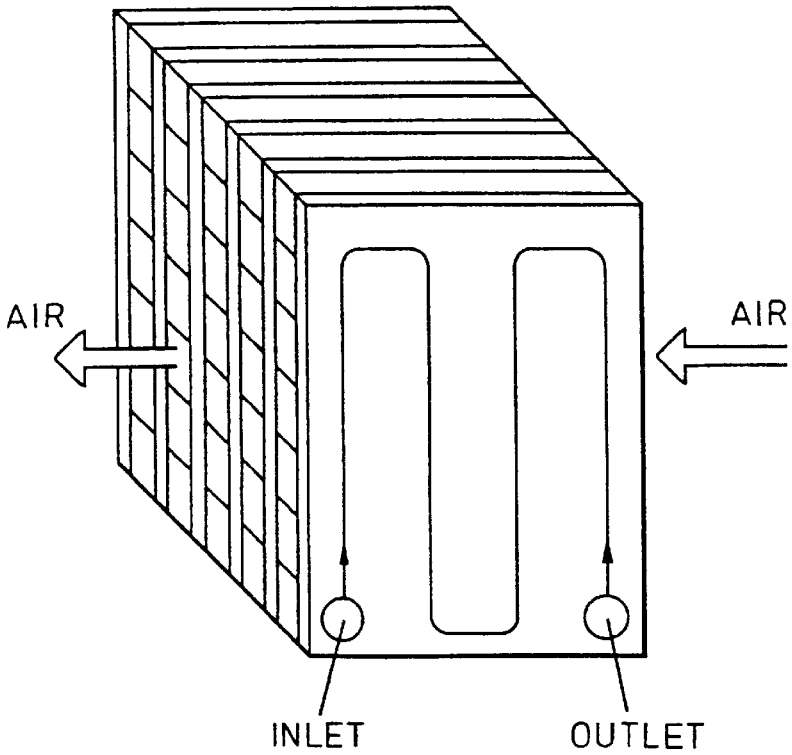
Figure 3:
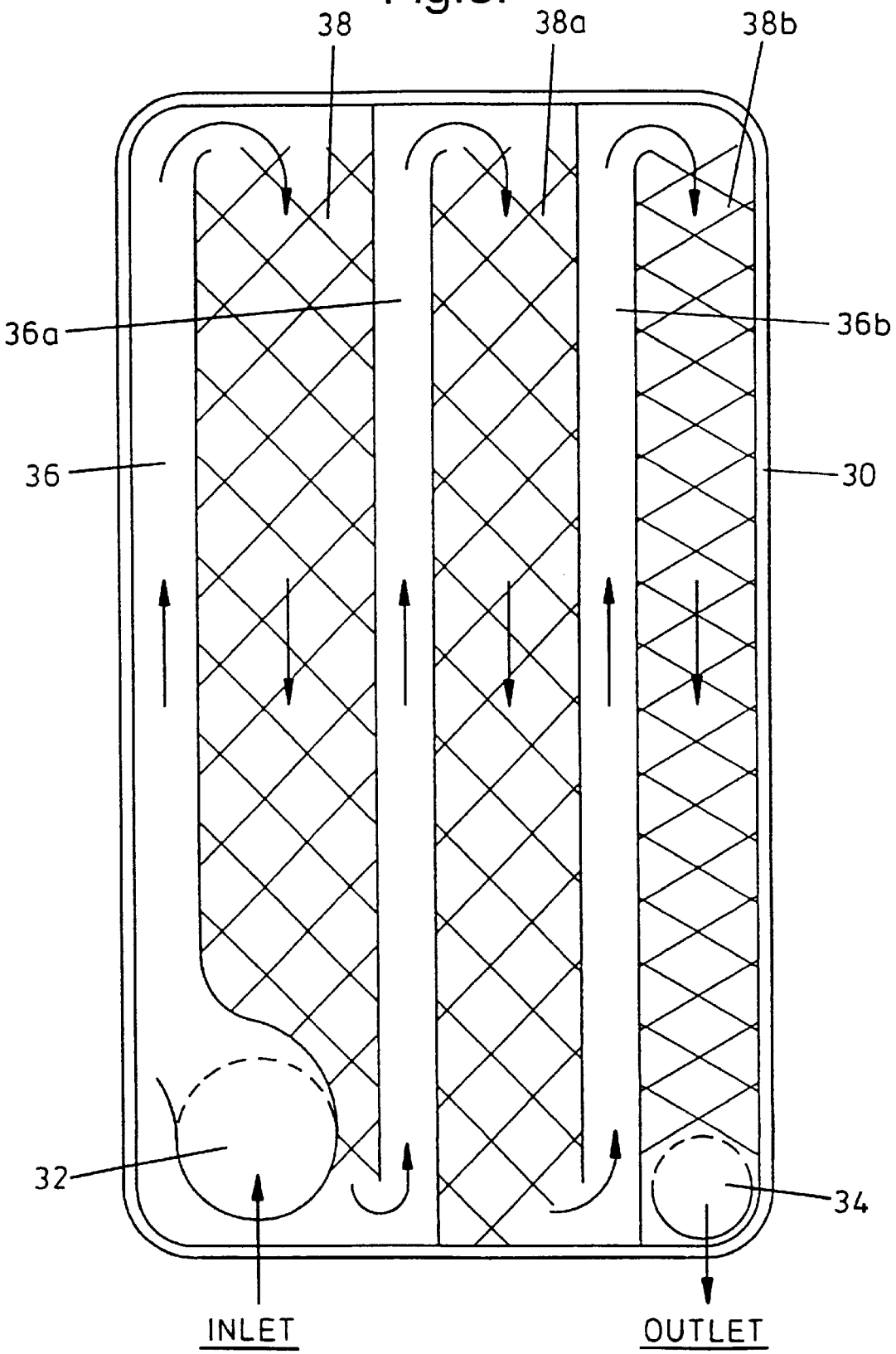
Figure 4:
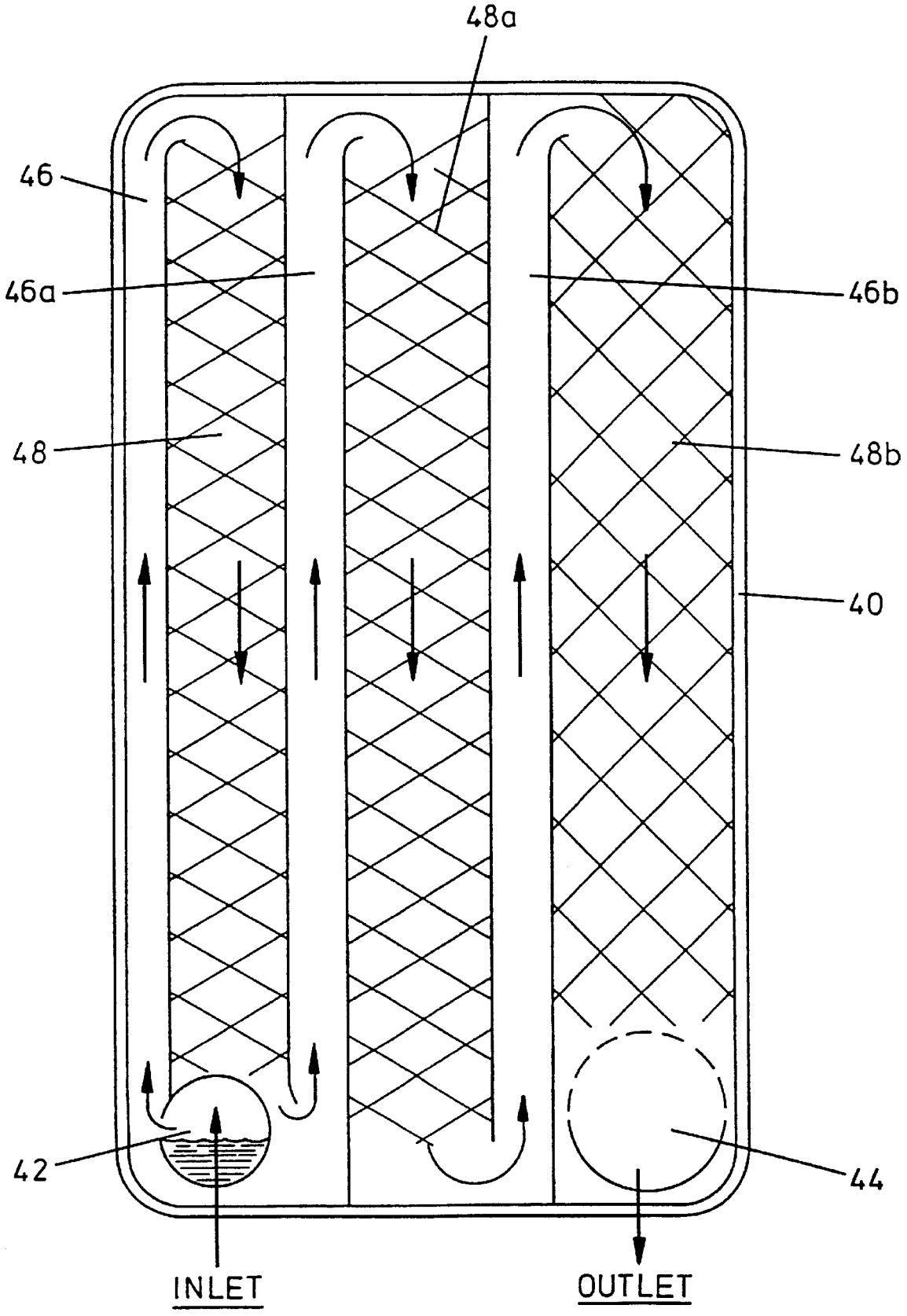
Figure 6:
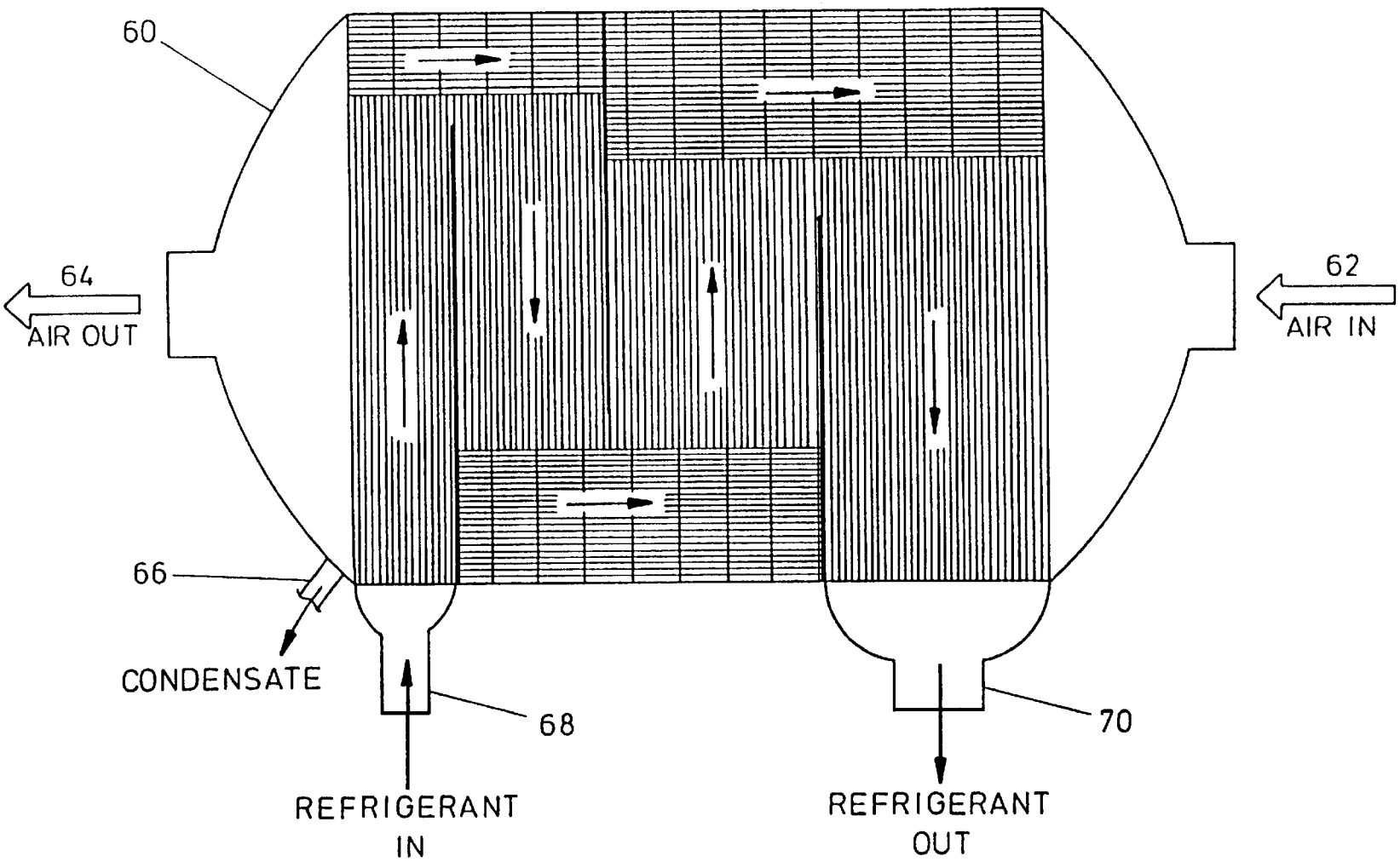
Figure 7:
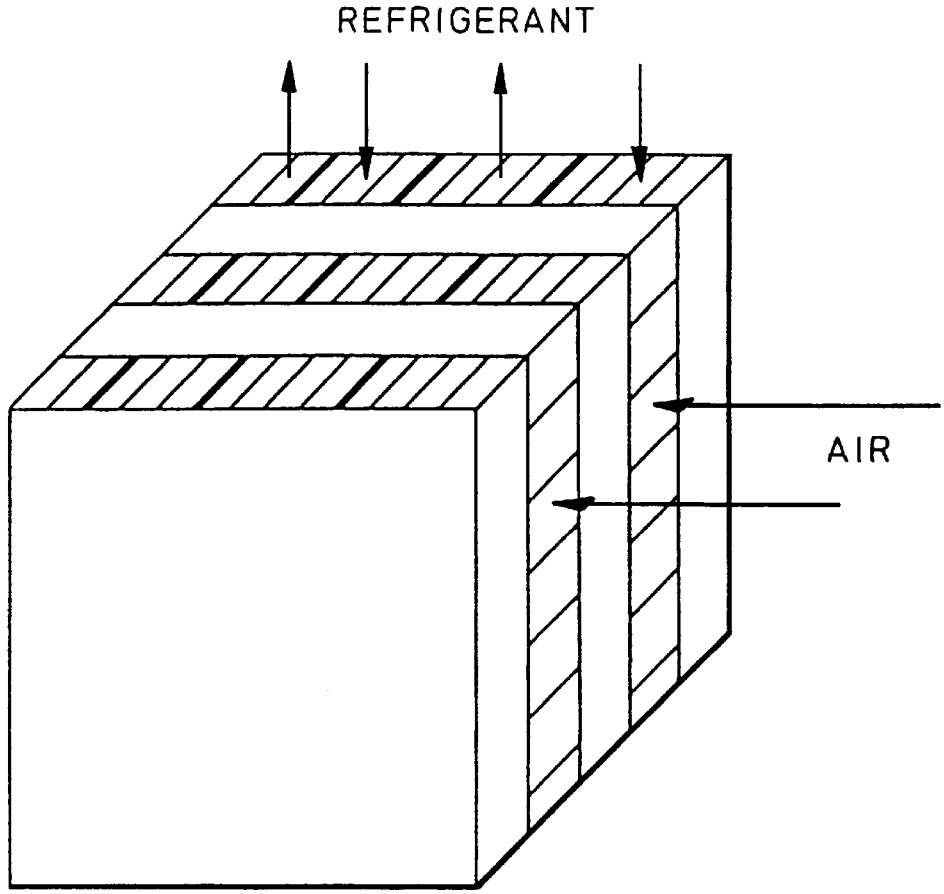
Figure 8:
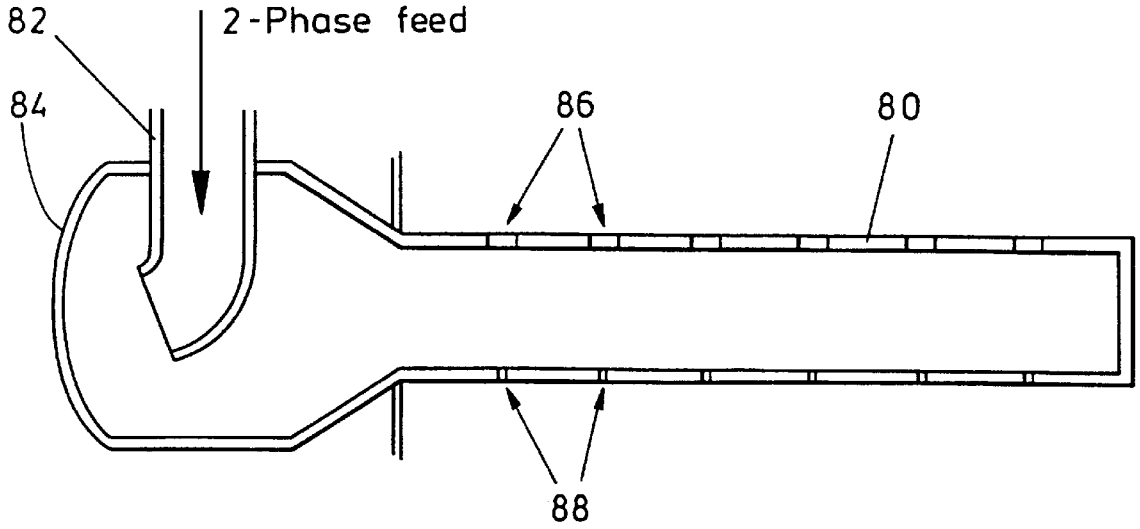

The present invention will now be described, by way of example only, with reference to the accompanying drawings, in which:

FIG. 1 is a schematic representation of a vapour compression system in which the condenser and the evaporator are each constructed in accordance with the present invention, FIG. 2 is an isometric view of the condenser or evaporator of the system shown in FIG. 1, FIG. 3 is a schematic representation of a heat exchanger according to the invention, suitable for use as a condenser, especially in small scale units, FIG. 4 is a schematic representation of a heat exchanger similar to that shown in FIG. 1, suitable for use as an evaporator, especially in small scale units, FIG. 5 is an isometric view of the heat exchangers shown in FIGS. 2 and 3, FIG. 6 is a schematic representation of a heat exchanger suitable for heat exchange with a process fluid in gas phase, especially when the scale is large, FIG. 7 is an isometric view, partially in section, of the heat exchanger shown in FIG. 6, and FIG. 8 is a sectional elevation through a device for distributing refrigerant between separate channels for refrigerant in a heat exchanger.

Referring to the drawings, FIG. 1 shows a vapour compression system which includes a compressor 2 for increasing the pressure of refrigerant vapour, a condenser 4 for high pressure refrigerant received from the compressor, and an evaporator 6 for liquid refrigerant received from the condenser. An expansion device 8 in the form of a float valve (of the general type disclosed in WO-A-92/06339) is provided to maintain the pressure differential between the condenser and the evaporator, and to control the withdrawal of liquid refrigerant from the condenser.

A receiver 10 is located downstream of the evaporator 6. The receiver includes a reservoir 12 into which liquid refrigerant discharged from the evaporator collects. In this way, supply of liquid refrigerant to the compressor can be minimised.

Each of the condenser 4 and the evaporator 6 consists of assemblies of plates, arranged in face-to-face relationship. Refrigerant flows through the heat exchangers (the condenser 4 and the evaporator 6) between alternate pairs of the plates, countercurrently with the process liquid which flows between the intermediate pairs of plates. The directions of flow of refrigerant and process liquid are countercurrent with respect to one another.

The plates from which the heat exchangers are formed have patterns of corrugations 14 formed in them. Refrigerant flowing along the channel defined between each pair of plates is forced to pass over the corrugations as it flows along each channel.

The pattern of the corrugations 14 changes between first and second regions 16, 18 of the condenser 4, and between first and second regions 20, 22 of the evaporator 6. In the condenser, the pattern of the corrugations changes so that the resistance to flow of refrigerant is greater at the outlet from the condenser than at the inlet. The reverse is true of the evaporator. The resistance to flow is altered by variation of at least one of the angle of the corrugations to the direction of flow of refrigerant, the depth of the corrugations, and the wavelength of the corrugations.

It can be appropriate for there to be more than just two corrugation patterns between the inlet and outlet manifolds.

FIG. 2 shows the condenser of the system shown in FIG. 1, and the directions of flow of the refrigerant and the fluid with which it is to exchange heat. The directions are essentially opposite to one another, with refrigerant flowing downwardly and a fluid such as water flowing upwardly.

An appropriate application for a vapour compression system of the type described above with reference to FIGS. 1 and 2 is in a water chiller, such as might be used for air conditioning of buildings.

FIG. 3 shows a pressed plate 30 which is suitable for use in the construction of a condenser. The condenser is formed from a plurality of complementary pairs of such plates arranged in a stack. The pairs of plates are separated by passages for flow of a process fluid which is to be heated, for example air or water. Fins are provided in the passages to increase the surface area for heat exchange with the said process fluid. Heat exchange takes place as refrigerant flows along the channel defined by the complementary pairs of plates. Refrigerant is supplied to the channel between each of the relevant pairs of plates through an inlet 32. The inlet bridges across the finned passages. Similarly, refrigerant is withdrawn from the channel between adjacent pairs of plates through an outlet 34. The inlet 32 and the outlet 34 extend through the entire stack of plates.

The channel along which the refrigerant flows between each pair of plates is directed so that the fluid flows alternately generally upwards and downwards. It comprises first and second sets of alternating parallel sub-channels. Refrigerant received into the channel from the inlet 32 first enters a sub-channel 36 along which it flows generally upwardly against minimal flow resistance. The low resistance to flow in the upwardly extending sub-channel leads to a high flow velocity for the fluid in the sub-channel. This facilitates mixing of fluid in vapour and liquid phases and subsequent equilibrium condensation or evaporation in the subsequent downwardly extending sub-channel. At the top of the sub-channel 36, the refrigerant flows into a sub-channel 38 of larger cross-sectional area in which the defining plates have corrugations formed in them which provide resistance to flow of refrigerant as it flows downwardly along the sub-channel 38.

This pattern of alternating upward flow against minimal flow resistance, and downward flow against resistance provided by corrugations, is repeated through respective sets of sub-channels 36*a*, 36*b* and 38*a*, 38*b* respectively.

The resistance to flow of refrigerant through the corrugated sub-channels 38 is increased in the last of the said sub-channels compared with that in the first such sub-channel. This variation in resistance is achieved by reduction of the cross-sectional area of the sub-channels, progressively along the length of the overall channel from the inlet 32 to the outlet 34. The resistance can also be changed by varying the pattern of the corrugations, in the manner generally as described above.

FIG. 4 shows a plate 40 of the type which can be used to form an evaporator. The evaporator is formed from a plurality of such plates arranged in a stack, in a manner similar to the formation of a condenser from the plate shown in FIG. 3.

The plate shown in FIG. 4 comprises an inlet 42 and an outlet 44, the inlet and outlet extending along the stack of plates. The channel extending from the inlet to the outlet between pairs of plates comprises sub-channels 46, 46*a*, 46*b* along which refrigerant flows upwardly, against minimal resistance. It further includes sub-channels 48, 48*a*, 48*b* along which refrigerant flows downwardly, against resistance provided by corrugations.

The resistance to flow of refrigerant along the sub-channels 48, 48*a*, 48*b* is reduced as refrigerant flows along the overall channel through the said sub-channels. The reduction in resistance to flow is achieved principally by increasing the cross-sectional area of the sub-channels, compared one with another. The resistance to flow can also be affected by changing the pattern of corrugations in the manner described above.

The construction of the inlet 42 is such that refrigerant is distributed substantially equally between the pairs of plates in both liquid and vapour phases. The inlet conduit is sufficiently large in cross-section for refrigerant to flow in it in both liquid and vapour phases. When the pairs of plates are bonded to one another, orifices are provided at or near the meridian of the manifold. Refrigerant vapour will tend to flow equally amongst the equal sized orifices, while the liquid will also tend to overflow equally amongst them, the liquid being picked up and carried along by the vapour.

The heat exchangers shown in FIGS. 3 and 4 involve local cross-flow between the refrigerant flowing in the channel defined by the plates and the process fluid which flows through the finned passages between the pairs of plates. However, by including several sub-channels, for example six sub-channels as shown, the overall contacting process between the fluids is essentially counterflow. The nature of the flow of the refrigerant and the liquid with which it is to exchange heat is illustrated in FIG. 5.

FIG. 6 shows an evaporator suitable for use in a vapour compression system, which can be used to cool compressed gases. It is suitable for cooling compressed air on a large scale.

The system comprises a stack of plates that are bonded together in a stack, defining channels between plates for flow of fluids. Fins are provided to increase the area available for heat exchange to each of the fluids. The pattern of the fins differs for the fluids. This type of construction can be used to exchange heat amongst three or more streams; the following description is restricted to exchange between two fluids, being a refrigerant and gases to be cooled.

An inlet manifold 62 is provided for gases to be cooled, with an outlet manifold 64 for gases which have not condensed. The inlet manifold 62 includes an appropriate header to ensure that air is distributed substantially uniformly between passages between the plates. In similar fashion, the outlet manifold 64 combines the flow of air from between the plates for discharge. The outlet manifold includes a condensate outlet 66 for condensed moisture. Cooling is achieved in the evaporator passages by means of refrigerant which passes between plates which are arranged in a stack. Refrigerant flows in channels between adjacent pairs of plates, between the refrigerant inlet 68 and the refrigerant outlet 70. The channel between each pair of plates has a boustrophedonic path. The cross-sectional area of the channel increases in successive passes, between the refrigerant inlet 68 and the refrigerant outlet 70. Fins are provided in the channel to direct the flow of refrigerant and to increase the area available for heat exchange to the refrigerant, particularly in the upward and downward limbs of the channel but not necessarily also in the limbs which extend laterally between the upward and downward limbs. By virtue of the change in cross-sectional are of the channel, the resistance to flow of refrigerant along the channel is reduced as the refrigerant flows along the channel.

The air which is to be cooled flows between the air inlet 62 and the air outlet 64 in the spaces between pairs of plates which define the channel for refrigerant. Fins are provided in the said spaces to optimise heat exchange with the air and to reinforce the plates so that they can withstand the pressures in the two fluid streams. The fins extend essentially straight through the heat exchanger, from the inlet manifold 62 towards the outlet manifold 64. The fins can be appropriately profiled to optimise the heat transfer, with corrugations, step configurations, perforations or other features as is established practice.

FIG. 7 shows the evaporator of FIG. 6 and the relationship between the flow paths for refrigerant and the fluid with which it is to exchange heat.

While the vapour compression system shown in FIG. 1 comprises both condenser and evaporator with changing resistance to refrigerant flow, it can be appropriate for some applications for the system to have just one heat exchanger (evaporator or condenser) arranged to function in this way. The other heat exchanger can be of another type. For example, a condenser of the type described above can be used with a fin-and-tube evaporator when air is being cooled, and heat is rejected to water. In another arrangement, an evaporator of the type described above can be used with a fin-and-tube condenser in an air-cooled water chiller.

FIG. 8 shows a device for distributing refrigerant between channels for refrigerant in an evaporator, for example of the type shown in FIGS. 4 and 5, in which refrigerant flows within adjacent pairs of plates, with the fluid in heat exchange relationship with the refrigerant flowing between the pairs of plates. The device comprises a distributor tube 80 which is closed at both ends. The device is located so that the distributor tube extends along the inlet of the evaporator. Refrigerant enters the tube through an inlet tube 82 which is bent slightly at its end so that refrigerant is discharged into the distributor tube laterally, towards an end 84 of the distributor tube. That end is flared and generally rounded. As the refrigerant impacts the end of the tube, turbulence is created so that liquid and vapour refrigerant remain in equilibrium with one another.

A series of outlet ports 86, 88 exist in the distributor tube for discharge of the refrigerant into the channels in the evaporator. The holes 86 in the top of the tube are bigger than the holes 88 in the bottom of the tube so that the relative proportions of refrigerant in vapour and liquid phases is controlled.

I claim:

1. A method of operating a vapour compression system which comprises at least two plates connected to one another in face-to-face relationship, the plates defining a channel in the space between them for flow of heat exchange fluid through the space from an inlet end thereof to an outlet end, the configuration of the channel being such that the resistance provided by the channel to the flow of heat exchange fluid therealong is greater in a first region towards one end of the channel than in a section region towards the other end of the channel, the method comprising flowing a heat exchange fluid comprising a mixture of non-azeotropic refrigerants generally vertically upwardly in the channel in heat exchange relationship with another fluid.

2. A method according to claim 1 wherein the step of flowing includes flowing liquid and vapour refrigerants co-currently.

3. A method according to claim 1 wherein the step of flowing includes flowing liquid and vapour refrigerants in equilibrium with one another.

4. A method according to claim 1 wherein the step of flowing includes flowing the heat exchange fluid in countercurrent relation with said another fluid.

5. A method according to claim 1 including maintaining equilibrium between the liquid and vapour phases throughout the flow of the non-azeotropic refrigerants upwardly in the channel and for the range of temperatures between a temperature of the refrigerants flowing in the first region and a temperature of the refrigerants flowing in the second region different than the temperature of the refrigerants in the first region.

6. A method of operating a vapour compression system having at least two plates connected to one another in face-to-face relationship and defining a channel in the space between them for flow of heat exchange fluid through the space from an inlet end to an outlet end, comprising the steps of:

providing the channel such that the resistance of the channel to flow of heat exchange fluid is greater in a first region adjacent one end of the channel than in a second region adjacent the other end of the channel;

orienting the channel in a generally vertically upward direction with the first and second regions elevated with respect to one another; and flowing a mixture of non-azeotropic refrigerants generally vertically upwardly in the channel in heat exchange relationship with another fluid.

* * * * *